US007357422B2

(12) United States Patent
Seidl

(10) Patent No.: US 7,357,422 B2
(45) Date of Patent: Apr. 15, 2008

(54) LABEL

(75) Inventor: Peter Seidl, Munich (DE)

(73) Assignee: Schreiner GmbH & Co. KG, Oberschleissheim (DE)

( * ) Notice: Subject to any disclaimer, the term of this patent is extended or adjusted under 35 U.S.C. 154(b) by 500 days.

(21) Appl. No.: 10/415,001

(22) PCT Filed: Oct. 19, 2001

(86) PCT No.: PCT/EP01/12138

§ 371 (c)(1),
(2), (4) Date: Aug. 29, 2003

(87) PCT Pub. No.: WO02/35504

PCT Pub. Date: May 2, 2002

(65) Prior Publication Data

US 2004/0041392 A1 Mar. 4, 2004

(30) Foreign Application Priority Data

Oct. 23, 2000 (DE) ..... 100 52 418

(51) Int. Cl.
*G09F 3/00* (2006.01)
*B42D 15/00* (2006.01)

(52) U.S. Cl. ..... 283/81; 283/101; 283/94; 428/41.7

(58) Field of Classification Search ..... 283/81, 283/94, 2, 5, 101; 428/40.1, 41.7
See application file for complete search history.

(56) References Cited

U.S. PATENT DOCUMENTS 4,621,837 A * 11/1986 Mack ..... 283/105
5,766,716 A * 6/1998 Barry ..... 428/40.1
6,120,637 A * 9/2000 Barry ..... 156/252
6,306,476 B1 * 10/2001 Barry ..... 428/40.1
6,541,090 B2 * 4/2003 Grosskopf et al. ..... 428/40.1
6,682,798 B1 * 1/2004 Kiraly ..... 428/40.1

* cited by examiner

*Primary Examiner*—Willmon Fridie, Jr.
(74) *Attorney, Agent, or Firm*—Nixon Peabody LLP; Donald R. Studebaker

(57) ABSTRACT

A label having information carriers provided with an imprint, with each semantically identical and provided in different languages and which are joined to one another as pages of a booklet by means of an adhesive binding. The transparent covering is placed on top of the uppermost booklet page and extends beyond the booklet pages on two sides, whereby the covering has an adhesive layer, which is located on the underside of the portions extending beyond the booklet pages and by means of which the covering is fixed to the container wall. The transparent covering is printed with batch-specific information, whereby the printed areas of the covering are aligned with non-printed areas of the booklet pages so that the uppermost booklet page which can be viewed through the transparent covering, and information printed on the transparent covering can be read together and supplement one another. When the uppermost booklet page is removed, the booklet page initially placed thereunder can be viewed through the covering, whereby the same information present before the uppermost booklet page was removed can now be read, however, in another language.

17 Claims, 3 Drawing Sheets

LABEL

BACKGROUND OF THE INVENTION

1. Field of the Invention

The present invention relates to a label, which has at least two superimposed information carriers with graphical or alphanumeric characters, an at least partially transparent cover, which lies on the uppermost information carrier and the information carrier projects over toward two sides in a plane parallel to the information carriers in at least one spatial direction, an adhesive layer, which at least partly covers at least the part of the cover projecting over the information carrier on the side of the cover facing the information carriers, so that by adhering the cover on a support surface, the information carriers are fixable beneath the cover on the support surface, and the graphical or alphanumeric characters are visible on the uppermost information carrier through the cover.

2. Description of Related Art

Containers with pharmaceutical products are typically provided with various information characterizing the contents, which, as a rule, occurs with printed labels. In this manner, distinctions between information can be made, which for a large number, remain the same on containers, for example, product names, materials of the preparation contained therein, and filling capacity, and information, which changes from order to order, under some conditions, from container to container, for example charge number, filling date, test number, etc.

If the pharmaceuticals are brought into different countries in commerce, the information must be provided in the corresponding language of the respective country. The use of common labels result that already, with labels, in must already be known in which country the container to be labeled is to be brought in commerce. If the containers are selected for an order for different countries, then these must be differently labels and already directly after the labeling, must be correspondingly packaged separately from one another, intermediary stored, and transported further, in order to ensure that they are supplied to their respective country of destination's distribution channels, such that, for example, a container inscribed in Dutch is not sent to Italy. This would mean a detrimentally logistical expense.

An alternative to the foregoing is a multi-language imprinting. Since, however, the available surface of the label is limited, here in particular, with small bottles and ampoule, borders are used, which contain one-layer labels. If common multi-layer labels are used, the so-called "booklet labels" or over-sealed folding sheets, such as are disclosed in EP 0 232 054 and EP 0 304 242, then the problem exists that still this same printed side of the booklet or folded sheets are visible on the container, since these, in common practice, are adhered with the back side of a transparent cover, which the booklet or folding sheets project over and fixes on the container. This has the result that one, with the container designation, must provide either a preferred language, or only a portion of the relevant information in a respective language that is well visible and legible on the container surface, since the printable surfaces of the above-lying side is separated into multiple languages.

With order or container specification information, most are treated with number combinations, such as expiration dates or order numbers, which are independent from the respective language. Merely the associated, explanatory text information, for example, "good until:", which first makes possible the interpretation, must be presented in the appropriate language. If one wants a specific reference between numeric combinations and corresponding explanatory information to be made, the two should be arranged at a minimal distance from one another, that is, in the best case, they are readable directly next to or under one another. This means for the use of a booklet-label of the above-described type, in which each printed side contains text in a different language, that the order or container specific information must be printed on each side. Since, typically, first container labels with non-order or non-container specific information are printed and provided in great amounts, the order or container specific information first printed shortly before the labels subsequently in a corresponding text gap, the efficiency with booklet-labels of the described type decreases.

SUMMARY OF THE INVENTION

The present invention is based on the problem of producing a label, which is suited for well-visible designation of a container in a specified language from a plurality of different languages, without already having to know with the labeling which of the different languages is to be determined for the designation or labeling. Therefore, container- or order-specific information as well as container- or order-nonspecific information should serve as designations, and the label should be changeable after application onto a container, such that the container- or order-specific information are legibly arranged in connection with explained container- or order-non specification information of the language determined for the designation.

This problem is resolved with a label, which has at least two superimposed information carriers with graphical or alphanumeric characters, an at least partially transparent cover, which lies on the uppermost information carrier and the information carriers project over toward two sides in a plane parallel to the information carriers in at least one spatial direction, an adhesive layer, which covers at last partially at least the part of the cover projecting over the information carrier, so that by adhering the cover on a support surface, the information carriers are fixable beneath the covering on the support surface, and the graphical or alphanumeric characters are visible on the uppermost information carrier through the covering, whereby at least the uppermost information carrier is at least partially removable from its starting position, so that the graphical or alphanumeric characters of the respective information lying thereunder are visible through the cover. In this manner, the cover has graphic or alphanumeric elements, which corresponds with the graphic or alphanumeric characters on the information carriers, such that interpretable information that is common to the respective graphic or alphanumeric characters visible through the cover is provided.

In one advantageous embodiment of the invention, the information carriers are parts of a continuous, folded material strip and via folds, are connected to one another, such that after removal of the uppermost information carrier from its starting position so that the graphical or alphanumeric characters of the respective information carrier lying thereunder are visible, the original, uppermost information carrier being placed in a position, which, originally, the other information carrier had occupied. In an advantageous manner, a piece of carrier material is formed on the lowermost of the information carriers, which is connected with the lowermost of the information carriers via a fold and on its lower side, has a second adhering layer.

In a further advantageous embodiment of the present invention, the information carriers are bounded together in the manner of a booklet, whereby the connection preferably is an adhesive binding. Advantageously, the lowermost of the bound information carriers is adhered to a piece of carrier material, which has a second adhering layer on its lower side.

In a particularly preferred form of the present invention, the piece of carrier material projects over the information carriers in a plane that is parallel to the information carriers in at least one spatial direction and the part of the carrier material that projects over the information carriers is adhered with a region of the part of the cover projecting over the information carrier.

In a further advantageous embodiment of the present invention, the part of the cover projecting toward a side of the information carrier is removable for taking off the information carriers from the support surface and is again adherable.

In a particularly advantageous embodiment of the present invention, the support surface is the cover surface of a cylindrical or prismatic container.

Preferably, in this connection, the dimensions of the label is selected, such that the part of the cover projecting toward a side of the information carrier overlaps the part of the cover projecting toward the opposite side of the information carrier in the state of being adhered to the support surface, whereby, preferably, the part of the cover projecting toward a side of the information carrier, with overlapping in adhered state, is at least partially siliconized or otherwise pretreated, so that the part of the cover projecting toward the other side of the information carrier, in the overlapping, adhered state, is removable for removal of the information carriers and is again adherable.

In a particularly advantageous embodiment of the present invention, a separable, printed voucher section is formed.

In a further advantageous embodiment of the present invention, the information carriers have a perforation, on which the part of each information carrier having the graphic or alphanumeric characters, is able to be torn off.

In a particularly preferred form of the present invention, the graphic or alphanumeric characters provide a text containing the same contents on each of the information carriers, the text, however, being in different languages on each of the information carriers. Thus, the label for designation of an object, onto which it is adhered, serves in a selected language, in which all information carriers are removed, which lie over the respective one which contains the text in the desired language.

As already stated, the present invention is suited in particular for identification of pharmaceutical containers.

Preferably, the label is arranged on a carrier made of release material, which is removable and which can be applied to the support surface.

Further forms, features, and advantages of the present invention will be described next with reference to FIGS. 1 through 4*b*, in which illustrate schematically embodiments of the present invention can be viewed in exemplary form.

BRIEF DESCRIPTION OF THE DRAWINGS

The drawing figure illustrates various embodiments of the invention as set forth below.

DETAILED DESCRIPTION OF THE INVENTION

Figure 1A:
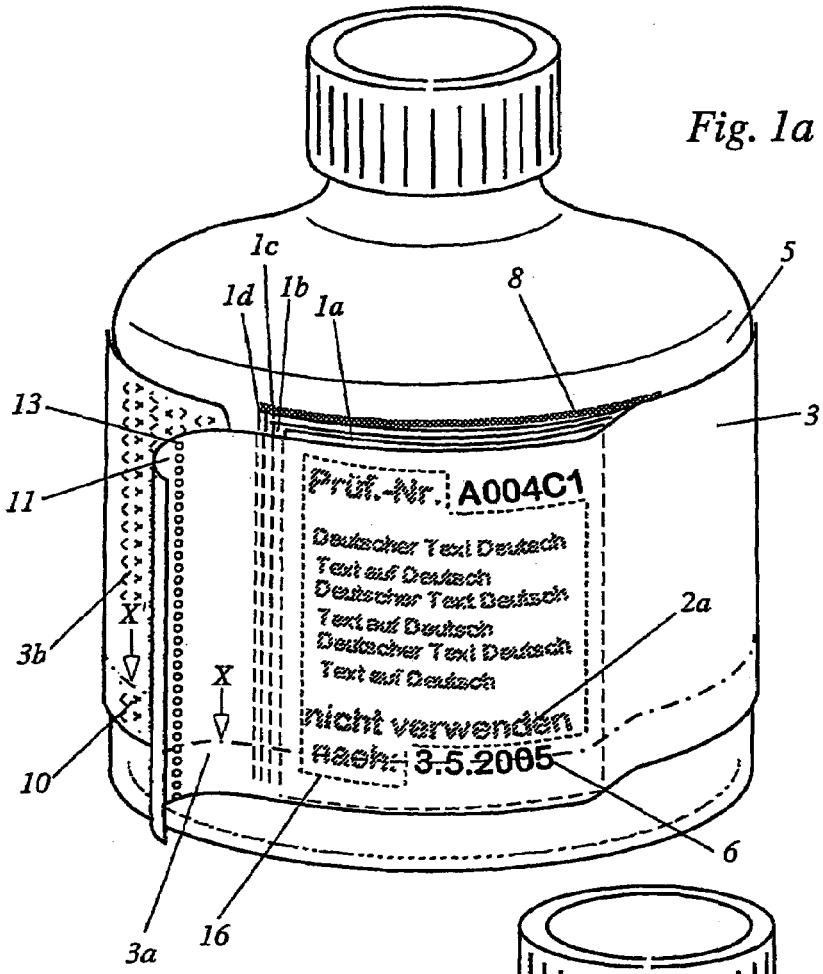
FIG. 1*a*: shows a label according to the present invention in a wrap-around form in an adhered state on a container with a partially pulled-away cover.

In FIG. 1*a*, a label according to the present invention is represented in a wrap-around form adhered to a container with a partially pulled-away cover 3, whereby the container, for example, can be a pharmaceutical container. The printed information carriers 1*a*, 1*b*, 1*c*, 1*d* form the pages of a booklet, whereby each booklet side 1*a*, 1*b*, 1*c*, 1*d* is inscribed with the substantively same information, however, in another language, which relates to the product contained in the container 5. The printed region 16 covers only a part of the surface of the booklet pages 1*a*, 1*b*, 1*c*, 1*d* and leaves areas free for information, which is specific for a product order, so that a type of space text or data mask with free fields exists. The cover 3 is transparent and lies on the uppermost booklet side 1*a*, so that is print 2*a* is readable through the transparent cover 3. The print of the booklet pages 1*b*, 1*c*, 1*d* lying thereunder is covered. The transparent cover 3 is printed with order-specific information 6, whereby the printed region of the cover 3 is aligned with the unprinted areas of the booklet pages 1*a*, 1*b*, 1*c*, 1*d*, so that the text gaps or free data fields of the print 2*a* are filled, and the information printed on the uppermost booklet side 1*a* and on the transparent cover 3 are readable in combination and reciprocally complementary.

On the basis of viewability, the booklet in FIG. 1*a* is illustrated narrow in proportion to the circumference of the container 5; for better use of the available cover surface of the container 5, the width of the booklet, however, also can be approximately three-fourths—according to the size of the container 5, also more—of the container circumference.

The lowermost side 1*d* of the booklet is applied to a piece of carrier material 8 that is adhered to the cover 3; the carrier material 8, in turn, is adhered to the surface of the container 5. The cover 3 projects over the booklet pages 1*a*, 1*b*, 1*c*, 1*d* in the circumferential direction toward two sides. The parts 3*a* and 3*b* of the cover projecting over the booklet are coated on their under sides with adhesive, whereby the cover 3 is fixed onto the container. The dimensions are selected, such that the parts 3*a*, 3*b* of the cover projecting over the booklet partially overlap one another, in the manner of a so-called wrap-around label. The part 3*b* is hereby siliconized on its upper side in a region of the overlapping 10, so that the part 3*a* can be pulled off in order to enable the cover 3 to wrap to a point that one or more of the booklet pages 1*a*, 1*b*, 1*c* can be removed easily. After removal, the cover 3 can again be re-wrapped and the part 3*a* can be newly adhered to the part 3*b*.

A printed voucher section 11 is formed on the cover 3 on the ends of the overlapping part 3*a*. The section 11 is divided at a perforation line 13, and can be re-adhered, for example, on a test document or prescription.

Figure 1B:
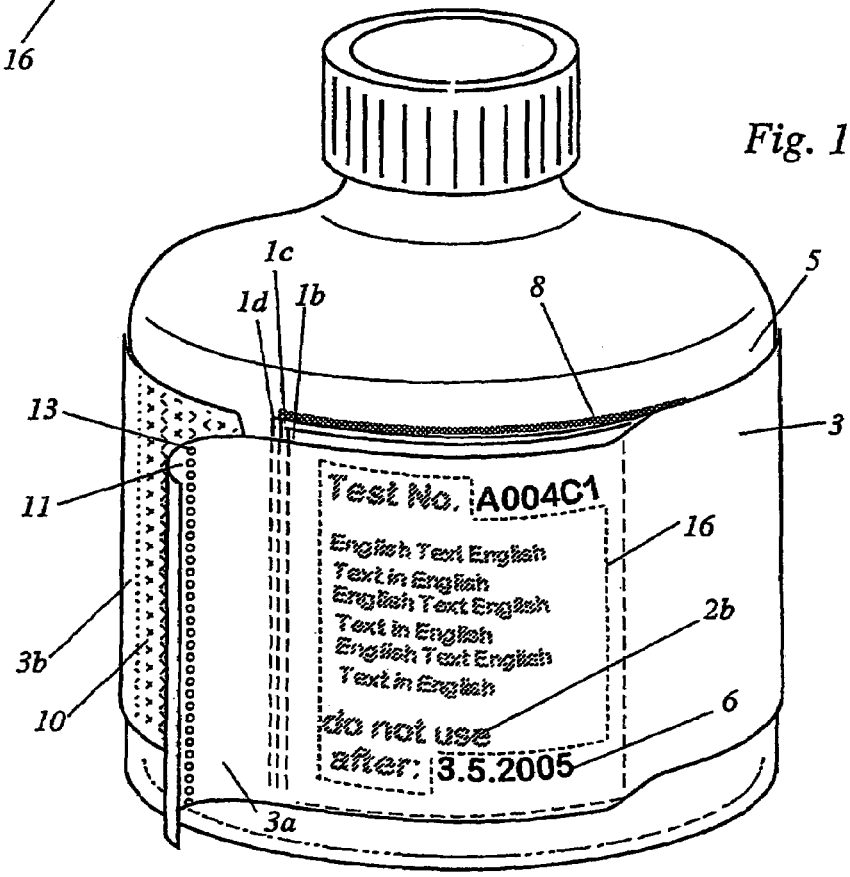
FIG. 1*b*: shows the label of FIG. 1*a* after removal of the uppermost information carrier.

FIG. 1*b* shows the label of FIG. 1*a* after removal of the uppermost information carrier 1*a*, so that the print 2*b* in the other language of the original, underlying book page 1*b* is visible through the transparent cover 3. Since, as stated above, the unprinted regions or free data field of the print 2*b* come to lie on the respective, approximately same positions under the cover 3, as before, the unprinted regions or free data fields of the print 2*a* on the original, uppermost booklet page 1*a*, the printed information on the booklet page 2*b* and on the transparent cover 3 are readable in combination and complete each other reciprocally. By removal of the originally uppermost booklet page 1*a*, the language of the printing of the container 5 changes, however, not the order-specific data printing 6.

Figure 2:
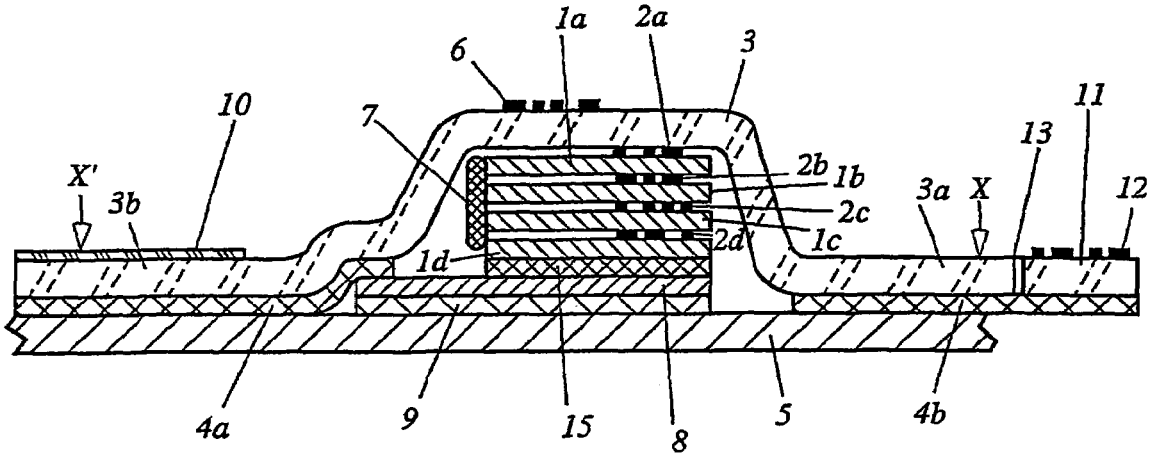
FIG. 2: shows a not-to-scale winding-off of the label of FIG. 1*a*, represented in longitudinal section with not-to-scale, greatly enlarged layer thicknesses.

The layer structure of the label of the present invention will be described with reference to FIG. 2, wherein a not-too-scale unwinding of the label of FIG. 1*a* is shown in longitudinal section with not-too-scale, greatly enlarged layer thicknesses.

The information carriers 1*a*, 1*b*, 1*c*, 1*d* are provided printing 2*a*, 2*b*, 2*c*, 2*d*, which is semantically the same but in different languages and connected to one another as pages 1*a*, 1*b*, 1*c*, 1*d*, of a booklet by an adhesive binding 7. The transparent cover 3 lies on the uppermost booklet page 1*a* and projects over the booklet pages 1*a*, 1*b*, 1*c*, 1*d* toward two sides, whereby the cover 3 has an adhesive layer on the under side of the parts 3*a*, 3*b* projecting over the booklet pages 1*a*, 1*b*, 1*c*, 1*d*, by means of which it is fixed onto the container wall 5.

The transparent cover 3 is printed with order-specific information 6, whereby the printed regions of the cover 3 are aligned with the unprinted regions of the booklet pages 1*a*, 1*b*, 1*c*, 1*d*, so that the printed information on the uppermost booklet page 1*a* visible through the transparent cover and on the transparent cover 3 are readable in combination and are mutually completed.

The part 3*a* of the cover 3 extending over the booklet pages 1*a*, 1*b*, 1*c*, 1*d* toward one side overlaps the part 3*b* of the cover 3 projecting toward the opposite side of the booklet pages 1*a*, 1*b*, 1*c*, 1*d*. The underlying part 3*b* in the overlapping has a siliconization 10 on its upper side, so that the overlying part 3*a* in the overlapping is removable for removal of the booklet pages 1*a*, 1*b*, 1*c* and is again adherable.

The lowermost booklet page 1*d* is connected with the piece of carrier material 8 via an adhesive layer 15, the carrier material 8 projecting over the booklet pages 1*a*, 1*b*, 1*c*, 1*d* toward one side. In its region extending over the booklet pages 1*a*, 1*b*, 1*c*, 1*d*, the piece of carrier material 8 is adhered with the part 3*b* of the cover 3 extending over the booklet pages 1*a*, 1*b*, 1*c*, 1*d*. On its underside, the piece of carrier material 8 has a further adhesive layer, with which it is adhered to the container wall 5.

On the upper-lying ends of the cover 3 upon overlapping, a voucher section 11 with printing 12 is formed, whereby the voucher section 11 is separable along a perforated line 13 from the cover 3, and, for example, can be adhered to a test document or prescription.

Figure 3:
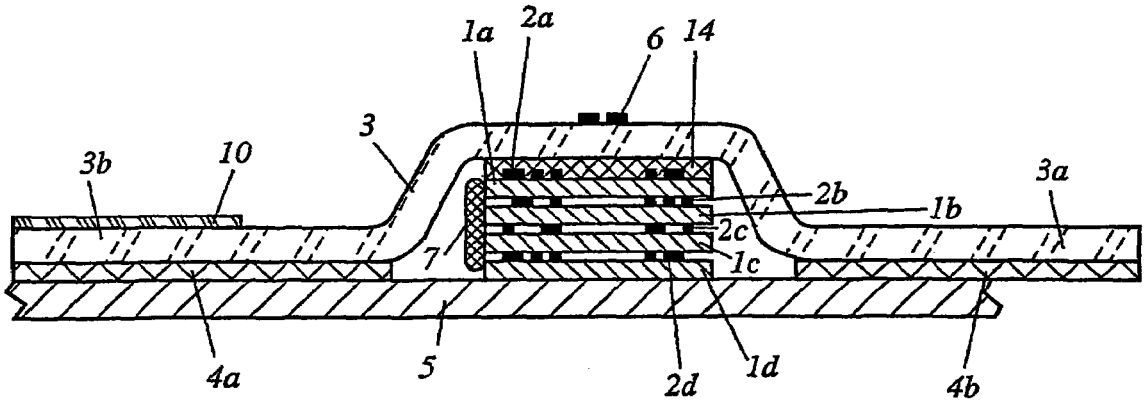
FIG. 3: shows a further embodiment of the label of the present invention in a wrap-around form, which is represented as winding-off in longitudinal section with not-to-scale, greatly enlarged layer thicknesses.

FIG. 3 shows a further embodiment of a label according to the present invention in a wrap-around form, which is represented as unwound in longitudinal section with not-to-scale, greatly enlarged layer thicknesses.

The information carriers 1*a*, 1*b*, 1*c*, 1*d* are provided with printing 2*a*, 2*b*, 2*c*, 2*d* that is semantically the same, however, in different languages, and are connected to one another as pages 1*a*, 1*b*, 1*c*, 1*d* of a booklet by an adhesive binding 7. The transparent cover 3 lies on the uppermost booklet page 1*a*. In this region, the cover 3 is provided with a layer 14 of a non-permanent adhesive, so that the booklet is releasably fixed to the cover 3.

The cover 3 extends over the booklet pages 1*a*, 1*b*, 1*c*, 1*d* toward two sides, whereby the cover 3 has an adhesive layer 4*a*, 4*b* on the underside of the parts 3*a*, 3*b* extending over the booklet pages 1*a*, 1*b*, 1*c*, 1*d*. By means of the adhesive layer 4*a*, 4*b*, the cover 3 is fixed on the container wall 5, whereby also the booklet is attached to the container wall 5.

The transparent cover 3 is printed with order-specific information, whereby the printed regions of the cover 3 align with the unprinted regions of the booklet pages 1*a*, 1*b*, 1*c*, 1*d*, so that the printed information on the booklet page 1*a* visible through the transparent cover and on the transparent cover 3 are readable in combination and complete one another in a complementary fashion.

The part 3*a* of the cover 3 extending over the booklet pages 1*a*, 1*b*, 1*c*, 1*d* toward one side overlaps the part 3*b* of the cover 3 extending over the booklet pages 1*a*, 1*b*, 1*c*, 1*d* toward the opposite side. The underlying part 3*b* upon overlapping has a siliconization 10 on its upper side, so that the overlying part 3*a* in the overlapping is removable for removal of the booklet pages 1*a*, 1*b*, 1*c* and again adherable.

In order to achieve the inscribing of the container 5 in a specified language, the part 3*a* is pulled off and the cover 3 wrapped, so that the booklet can be removed. Subsequently, so many booklet pages 1*a*, 1*b*, 1*c* are removed from above, until the booklet page 1*a*, 1*b*, 1*c*, 1*d* printed in the desired language lies on top. After pressing the booklet to the non-permanent adhesive layer 14, so that the printing 2*a*, 2*b*, 2*c*, 2*d* of the desired booklet page 1*a*, 1*b*, 1*c*, 1*d* is visible through the transparent cover and stands with the printing 6 in gaps, so that the respective printed information is readable in combination and complementarily completes one another, the cover 3 is wrapped back and the part 3*a* again adhered to the part 3*b*, whereby the booklet is fixed to the container 5.

Figure 4A:
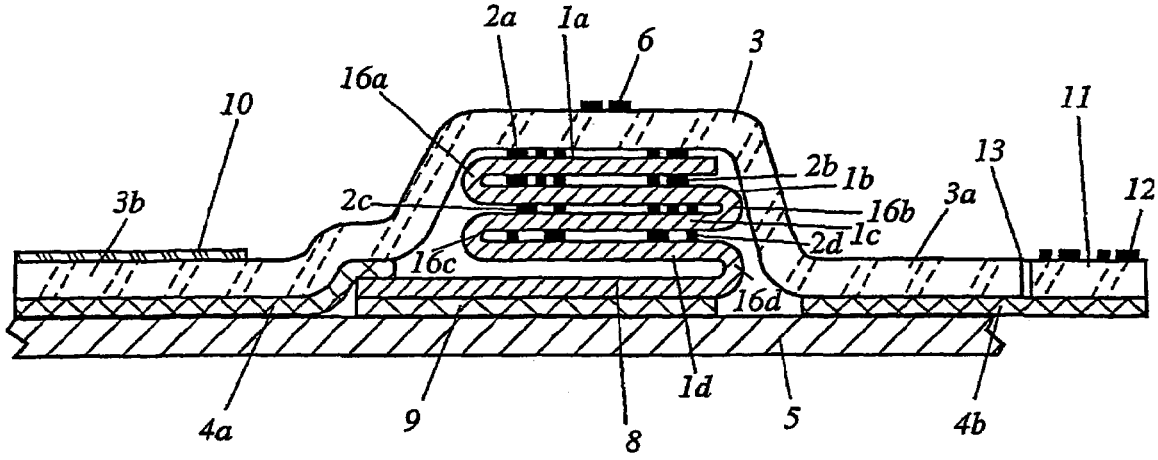
FIG. 4*a*: shows a further embodiment of a label according to the present invention in a wrap-around form, which is represented as winding-off in longitudinal section with not-to-scale, greatly enlarged layer thicknesses.

FIG. 4*a* shows a further embodiment of a label according to the present invention in a wrap-around form, which is represented as unwinding in longitudinal section with not-to-scale, greatly enlarged layer thicknesses.

The information carriers 1*a*, 1*b*, 1*c*, 1*d* are provided with printing 2*a*, 2*b*, 2*c*, 2*d* that is semantically the same, however, in different languages, and as pages 1*a*, 1*b*, 1*c*, 1*d* of a folded sheet connected to one another by folds 16*a*, 16*b*, 16*c*. The transparent cover 3 lies on the uppermost folded sheet page 1*a* and extends over the folded sheet pages 1*a*, 1*b*, 1*c*, 1*d* toward two sides, whereby the cover 3 has an adhesive layer 4*a*, 4*b* on the underside of the parts 3*a*, 3*b* extending over the folded sheet pages 1*a*, 1*b*, 1*c*, 1*d*, by means of which it is fixed to the container wall 5.

The transparent cover 3 with printed with order-specific information 6, whereby the printed regions of the cover 3 align with the unprinted regions of the folded sheet pages 1*a*, 1*b*, 1*c*, 1*d*, so that the information printed on the uppermost folded sheet page 1*a* visible through the transparent cover and on the transparent cover 3 are readable in combination and complete one another in complementary fashion.

The part 3*a* of the cover 3 extending over the folded sheet pages 1*a*, 1*b*, 1*c*, 1*d* toward one side overlap the part 3*b* extending over the folded sheet pages 1*a*, 1*b*, 1*c*, 1*d* toward the opposite side. The underlying part 3*b* in the overlap has on its upper side a siliconization 10, so that the part 3*a* lying on top in the overlap for changing of the folding of the folded sheet is removable and again adherable.

A piece of carrier material 8 is formed on the lowermost folded sheet page 1*d* via a fold 16*d*, the carrier material 8 extending over the folded sheet pages 1*a*, 1*b*, 1*c*, 1*d* toward one side. In its region projecting over the folded sheet pages 1*a*, 1*b*, 1*c*, 1*d*, the piece of carrier material 8 is adhered with the page 3*b* of the cover extending over the folded sheet pages 1*a*, 1*b*, 1*c*, 1*d*. On its underside, the piece of carrier material 8 has a further adhesive layer 9, with which it is adhered to the container wall 5.

On the ends of the cover 3 lying on the top in the overlap, a voucher section 11 with printing 12 is formed, whereby the voucher section 11 is separable along a perforated line 13 from the cover 3, and for example, can be adhered on a test document or prescription.

In order to change the language of the visible container inscription, the part 3*a* is pulled off and the cover wrapped around, so that the folded sheet pages 1*a*, 1*b*, 1*c*, 1*d* can be brought by folding into a different sequence, in which the printing 2*a*, 2*b*, 2*c*, 2*d* of the desired language comes to lie on the top. After folding, the cover 3 is re-wrapped and the part 3*a* again adhered to the page 3*b*.

Figure 4B:
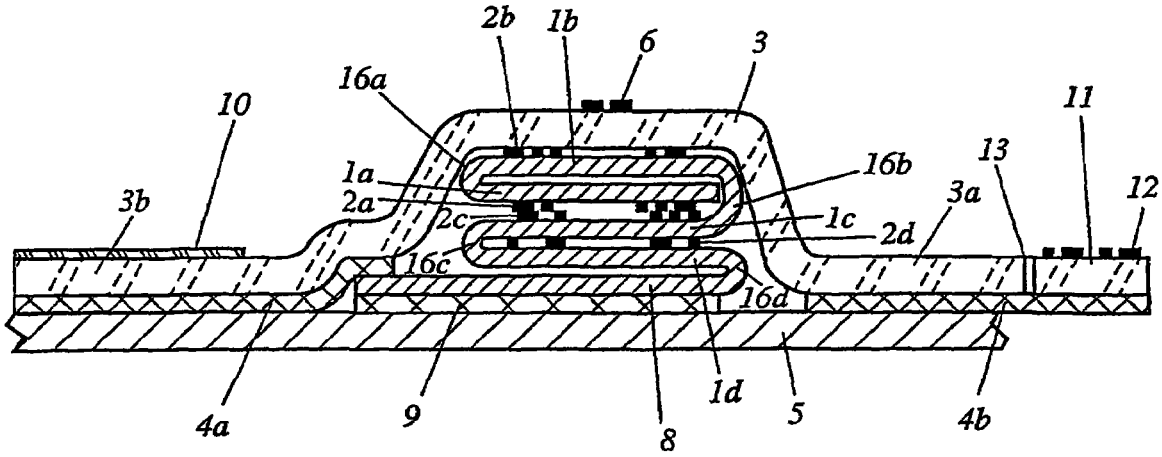
FIG. 4*b*: shows a winding-off of the label of FIG. 4*a* in longitudinal section with not-to-scale, greatly enlarged layer thicknesses, whereby the original, uppermost information carrier is folded back, so that the original second, uppermost information carrier is no longer uppermost.

FIG. 4*b* shows an unwinding of the label of FIG. 4*a* in longitudinal section with not-to-scale, greatly enlarged layer thickness, whereby the original, uppermost folded sheet page 1*a* is folded back, so that the original, second folded sheet page 1*b* from the top is at the uppermost position.

Commercial Utility

Should pharmaceuticals be brought into different countries in commerce, the container information, respectively, must be provided in the corresponding language of the country. The present invention offers pharmaceutical companies the advantage that with labels in which it is not yet known into which country it is to be brought, since the language of the visible information can simply be changed after labeling, without detrimentally affecting the order-specific printing. Since many pharmaceuticals are brought into commerce worldwide in many million barrels, an attractive market is offered for the product according to the present invention.

The invention claimed is:

1. A label, comprising at least two superimposed information carriers with graphic or alphanumeric characters;

a cover that is at least partially transparent, which rests on an uppermost information carrier and a part a of which projects over the information carriers on two sides in at least a spatial direction in a plane that is parallel to the information carriers in at least one spatial direction;

an adhesive layer, which at least partially covers, on a side of the cover facing toward the information carriers at least the part of the cover projecting over the information carriers on a side of the cover facing toward the information carrier, so that by adhering the cover onto a substrate, the information carriers are fixable beneath the cover on the substrate, and the graphic and alphanumeric characters on the uppermost information carrier are visible through the cover, wherein at least the uppermost information carrier is at least partially removable from a starting position, so that the graphic and alphanumeric characters of one of the respective information carriers lying thereunder are visible through the cover, the information carriers have free fields between the graphic and alphanumeric characters and the cover arranged over the free fields of the information carrier visible through the cover, has graphic or alphanumeric elements that correspond with the graphic or alphanumeric characters on each of the information carriers, such that interpretable information is formed by the graphic or alphanumerical elements on the cover together with the respective graphic or alphanumeric characters that are visible through the cover is provided.

2. The label according to claim 1, wherein the information carriers are part of a continuous, folded material strip and are connected to one another by means of folds, such that after removal of the uppermost information carrier from a starting position so that the graphic or alphanumeric characters of the respective information carrier lying thereunder are visible through the cover, wherein the original uppermost information carrier is placed in a position occupied originally by the other information carrier.

3. The label according to claim 2, wherein on a lowermost of the information carriers, a piece of carrier material is formed, which is connected with the lowermost information carrier by means of a fold and on its lower side, has a second adhering layer.

4. The label according to claim 1, wherein the information carriers are bound together in a manner of a booklet.

5. The label according to claim 4, wherein the binding of the information carriers is an adhesive binding.

6. The label according to claim 4, wherein the lowermost of the bound information carriers is adhered on a piece of carrier material, which has a second adhesive layer on its under side.

7. The label according to claim 3, wherein the piece of carrier material projects over the information carriers in a plane that is parallel to the information carriers in at least one spatial direction and a part of the carrier material that projects over the information carrier is adhered with a region of a part of the cover that projects over the information carrier.

8. The label according to claim 1, wherein the part of the cover that projects over toward a side of the information carriers is releasable for removal of the information carriers from the support surface and is re-adherable.

9. The label according to claim 1, wherein the support surface is the cover surface of a cylindrical or prismatic container.

10. The label according to claim 9, wherein dimensions of the label are selected so that the part of the cover projecting over toward a side of the information carriers overlaps at least partially the part of the cover projecting over toward an opposite side of the information carriers in a state of being adhered to the support surface.

11. The label according to claim 10, wherein the part of the cover that projects toward a side of the information carriers in the overlapping, adhered state is provided with an adhesive layer on an upper side.

12. The label according to claim 1, wherein a separable, printed voucher section is formed on the cover.

13. The label according to claim 1, wherein the information carriers have a perforation, wherein a part of each information carrier having the graphic or alphanumeric characters can be torn away at the perforation.

14. The label according to claim 1, wherein the graphic or alphanumeric characters on each information carrier provide a text containing the same contents in a language that is different from that of the respective other information carrier.

15. The label according to claim 1, wherein the support surface is the surface of a pharmaceutical container.

16. The label according to claim 1, wherein the label is disposed on a carrier made of release material, wherein the label is releasable from the release material and applicable to the support surface.

17. A label comprising at least two superimposed information carriers, of which each is printed with text information in a different language, wherein the text information of one information carrier corresponds to that of the other information carrier, and which further has an at least partially transparent cover with at least two outward parts projecting over the information carrier in a plane that is substantially parallel to the information carriers, whereby the cover and the parts projecting over the information carriers have a common under side, which is at least partially self-adhesive at least in a region of the parts projecting over the information carriers, so that by adhering the parts projecting over the information carriers on a support surface, the information carriers are fixable beneath the cover on the support surface, whereby the text information of one of the information carriers is visible through the cover, and by removal of the information carrier whose text information is visible through the cover from its starting position, the text information of the other information carrier is visible through the cover, and whereby the cover has information printed thereon, which substantively completes the text information visible through the cover.

* * * * *